US007568701B1

(12) United States Patent
Gallagher et al.

(10) Patent No.: US 7,568,701 B1
(45) Date of Patent: Aug. 4, 2009

(54) CARD GAME

(76) Inventors: L. Scott Gallagher, 133 Ousamequin Pines Rd., E. Bridgewater, MA (US) 02333; Christina L. Gallagher, 133 Ousamequin Pines Rd., E. Bridgewater, MA (US) 02333

( * ) Notice: Subject to any disclaimer, the term of this patent is extended or adjusted under 35 U.S.C. 154(b) by 183 days.

(21) Appl. No.: 11/803,229

(22) Filed: May 14, 2007

Related U.S. Application Data

(63) Continuation-in-part of application No. 11/127,597, filed on May 13, 2005, now Pat. No. 7,216,869.

(51) Int. Cl.
*A63F 1/00* (2006.01)

(52) U.S. Cl. ..... 273/274; 463/26

(58) Field of Classification Search ..... 273/274, 273/292, 309; 463/12, 13, 26–28
See application file for complete search history.

(56) References Cited

U.S. PATENT DOCUMENTS

| | | | | |
|---|---|---|---|---|
| 5,265,882 | A * | 11/1993 | Malek | 273/292 |
| 5,593,161 | A * | 1/1997 | Boylan et al. | 273/274 |
| 5,718,431 | A * | 2/1998 | Ornstein | 273/292 |
| 6,189,888 | B1 * | 2/2001 | Brunelle | 273/292 |
| 6,439,573 | B1 * | 8/2002 | Sklar | 273/292 |
| 6,550,772 | B1 * | 4/2003 | Streeks et al. | 273/292 |
| 6,575,467 | B1 * | 6/2003 | Kal | 273/292 |
| 6,585,588 | B2 * | 7/2003 | Hartl | 463/16 |
| 6,648,754 | B2 * | 11/2003 | Baerlocher et al. | 463/17 |
| 6,679,492 | B2 * | 1/2004 | Markowiak | 273/138.1 |
| 7,048,274 | B2 * | 5/2006 | Duncombe et al. | 273/274 |
| 7,118,111 | B1 * | 10/2006 | Altomare | 273/292 |
| 7,137,629 | B2 * | 11/2006 | Chapman | 273/292 |
| 7,175,522 | B2 * | 2/2007 | Hartl | 463/11 |
| 7,419,162 | B2 * | 9/2008 | Lancaster et al. | 273/292 |
| 2001/0034262 | A1 * | 10/2001 | Banyai | 463/17 |
| 2004/0061288 | A1 * | 4/2004 | Snow | 273/274 |
| 2004/0084843 | A1 * | 5/2004 | Snow | 273/292 |
| 2007/0252333 | A1 * | 11/2007 | Hernandez | 273/292 |

* cited by examiner

*Primary Examiner*—William M. Pierce
(74) *Attorney, Agent, or Firm*—John P. McGonagle

(57) ABSTRACT

A wagering game between a dealer and one or more players involving one or more decks of cards, a plurality of betting boards and player markers. Each betting board has four betting places, each place corresponding to one of four card suits, said betting places being arranged near the bottom of the betting board. Each player makes a bet by selecting a betting place with a marker. A dealer deals one card. If the betting place matches the suit of the card dealt, the player is a winner. If the player's betting place does not match the suit of the card dealt, the player loses and the dealer moves the losing player's wager to a jackpot area. The winner of the jackpot is the player having a bet matching the suit of the card dealt and having a card with the highest rank of other cards matching suits.

3 Claims, 5 Drawing Sheets

CARD GAME

CROSS-REFERENCE TO RELATED APPLICATIONS

This is a Continuation-In-Part of U.S. patent application Ser. No. 11/127,597, filed May 13, 2005, now U.S. Pat. No. 7,216,869, Issued May 15, 2007.

BACKGROUND OF THE INVENTION

This invention relates to wagering games involving a dealer, one or more players, and one or more decks of cards having a plurality of suits.

Many card games have been developed and some are particularly adapted for gambling. One class of such games includes a dealer who deals cards and a plurality of players who place wagers based on the cards that the dealer deals. Various progressive jackpot wagering games have also been developed. Other games also disclose the concept of adding additional wagers when cards are dealt.

There is a demand for new card games, particularly by casinos, which are, at the same time, innovative and interesting, but simple enough for players to easily learn. It has been found that many potential players are discouraged from playing because they do not understand the complexity of the game and are self-conscious about showing their lack of expertise.

Accordingly, it is an object of the present invention to provide an improved wagering game, which is innovative and interesting.

It is also an object of the invention to provide an improved wagering game for casinos which is simple enough for most persons to understand without complicated instructions.

SUMMARY OF THE INVENTION

In accordance with these objects, there is provided, according to one aspect of the invention, a wagering game between a dealer and one or more players involving one or more decks of cards, a plurality of betting boards and player markers. Each betting board has four betting places, each place corresponding to one of four card suits, said betting places being arranged near the bottom of the betting board. The object of the game is to be the player at the table that correctly matches the suit dealt to him by the dealer, making him a "Survivor" in the quest to be a High Survivor and collect the table jackpot.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
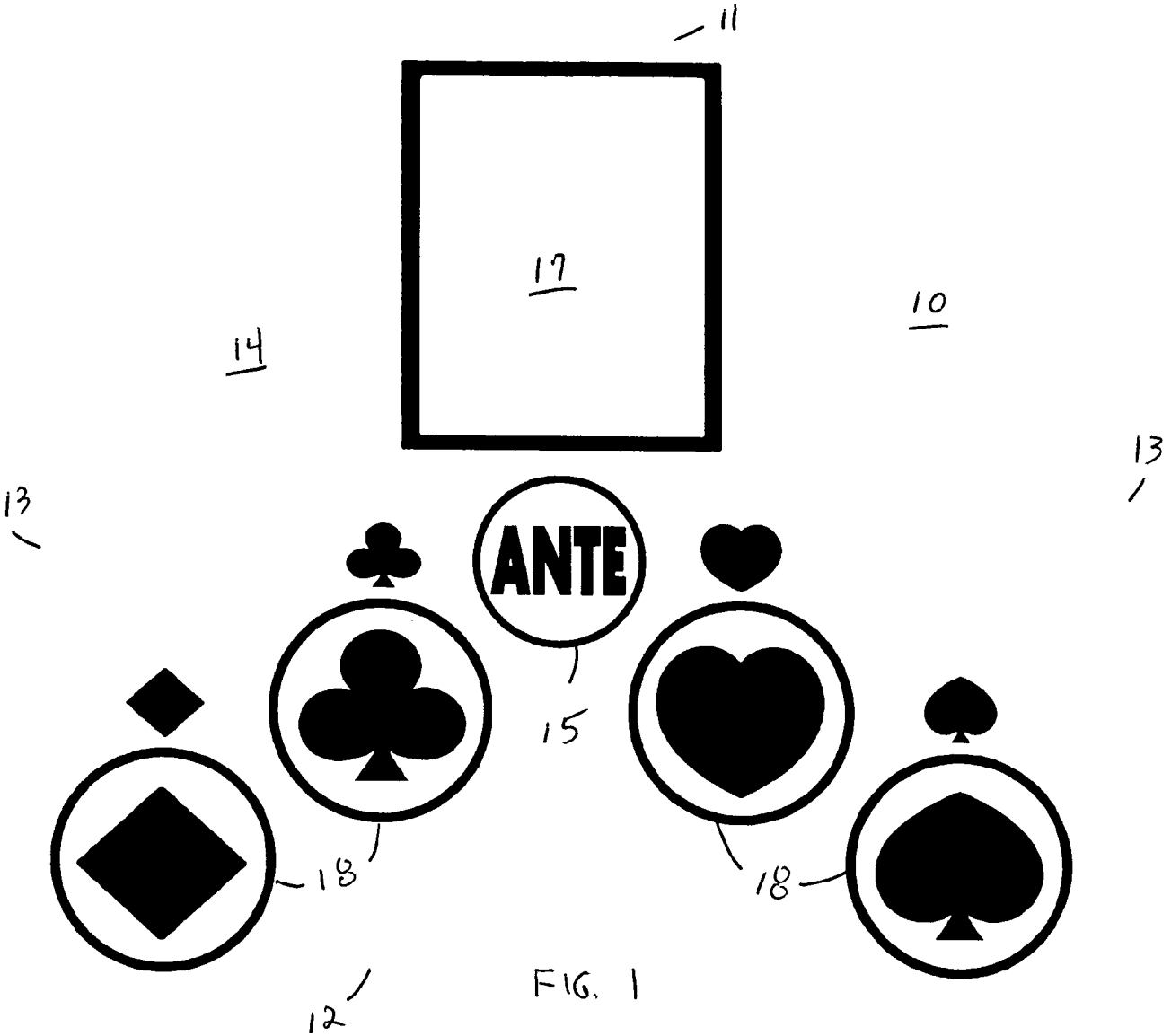
FIG. 1 is a top plan view of a betting board used in the invention.

Referring to the drawings in detail wherein like elements are indicated by like numerals, there is shown in FIG. 1 a generally rectangular, flat, player's betting board 10 having a top 11, bottom 12, two opposite side edges 13 and a playing surface 14. The playing surface 14 has a plurality of betting spaces 18 arranged near to the bottom 12 of the betting board 10, said betting spaces 18 representing the four suits of a standard deck of playing cards. Immediately above the row of betting spaces 18 is a space 15 marked "ANTE". Adjacent the player board top 11 is an area 17 for the player's card.

Figure 2:
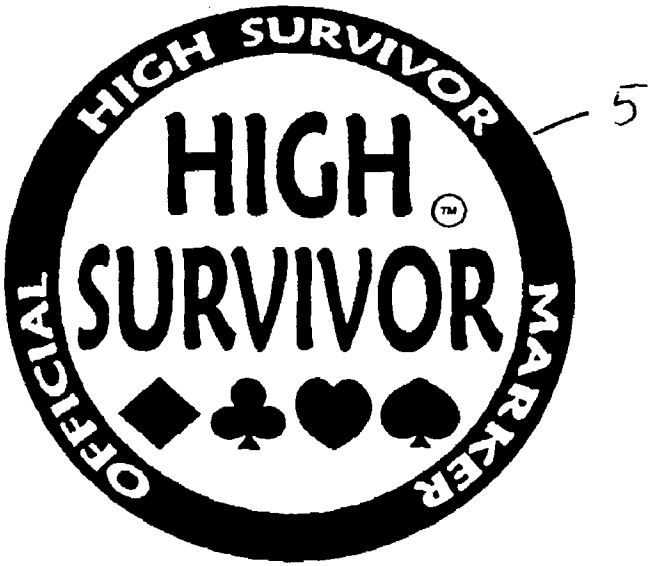
FIG. 2 is a top plan view of a marker used in play.
Figure 3:
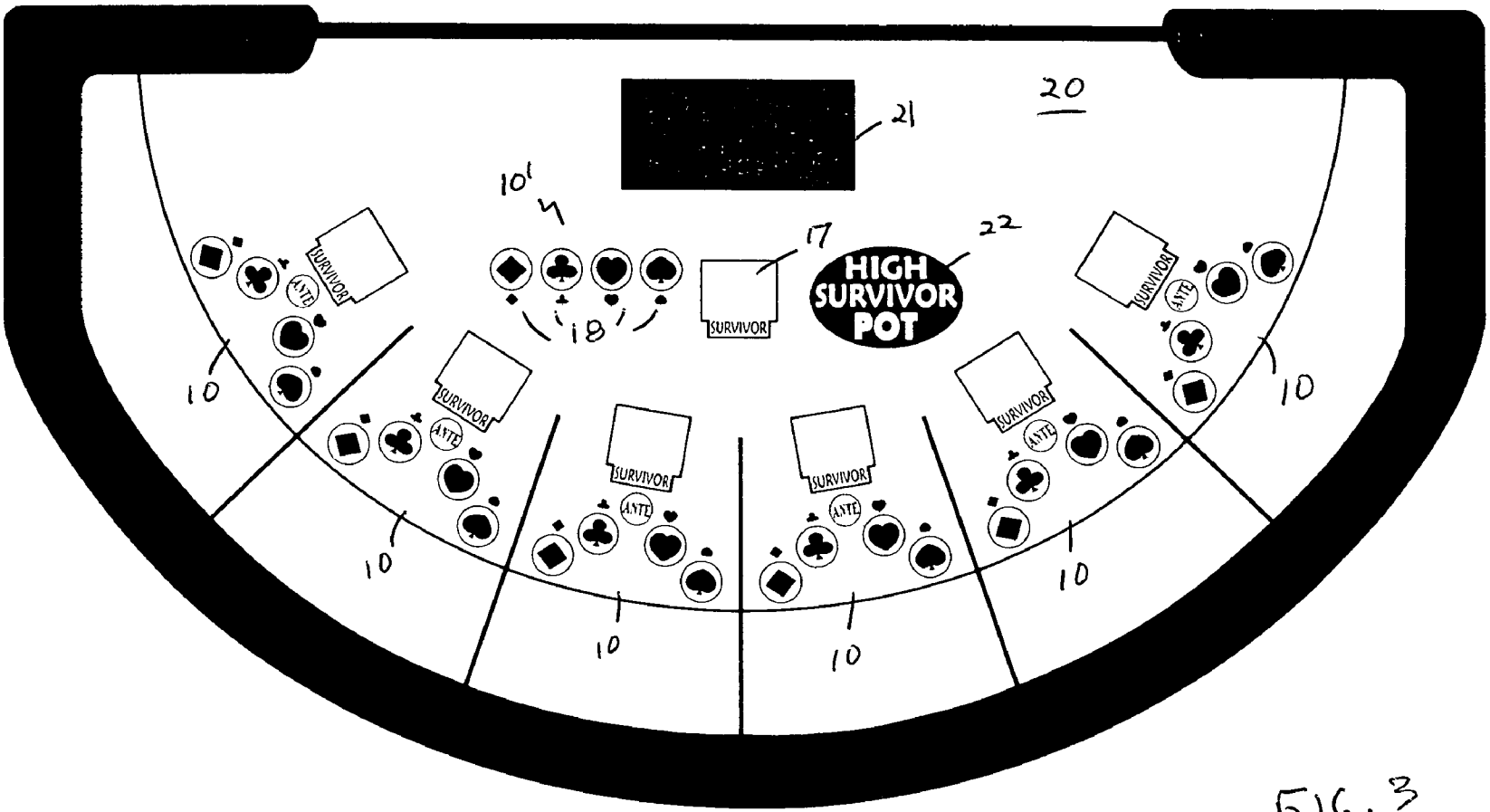
FIG. 3 is a top plan view of a table layout with multiple betting boards for multiple players.
Figure 4A:
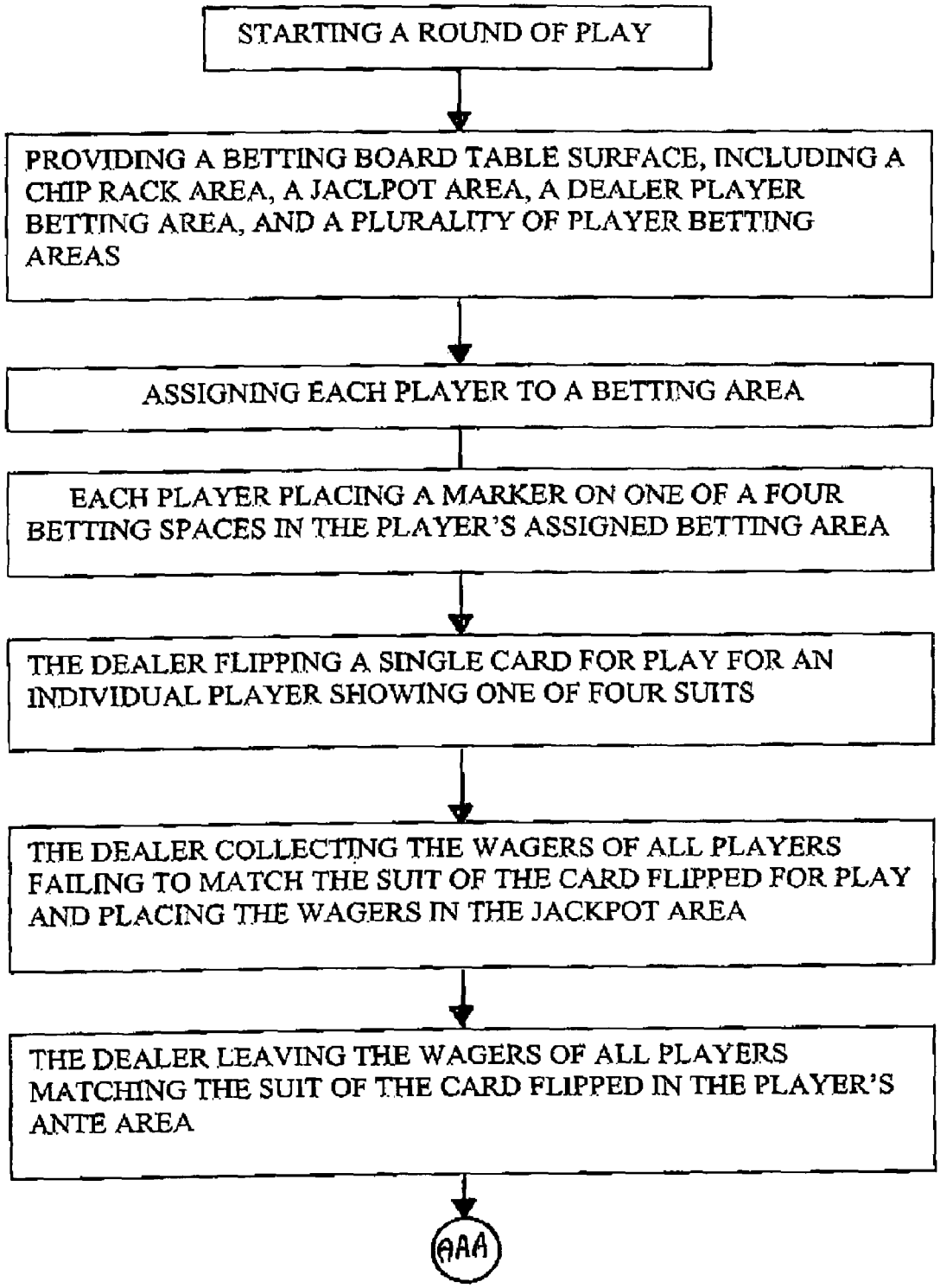
FIG. 4A is the first half of a block diagram representing the flow of the game.
Figure 4B:
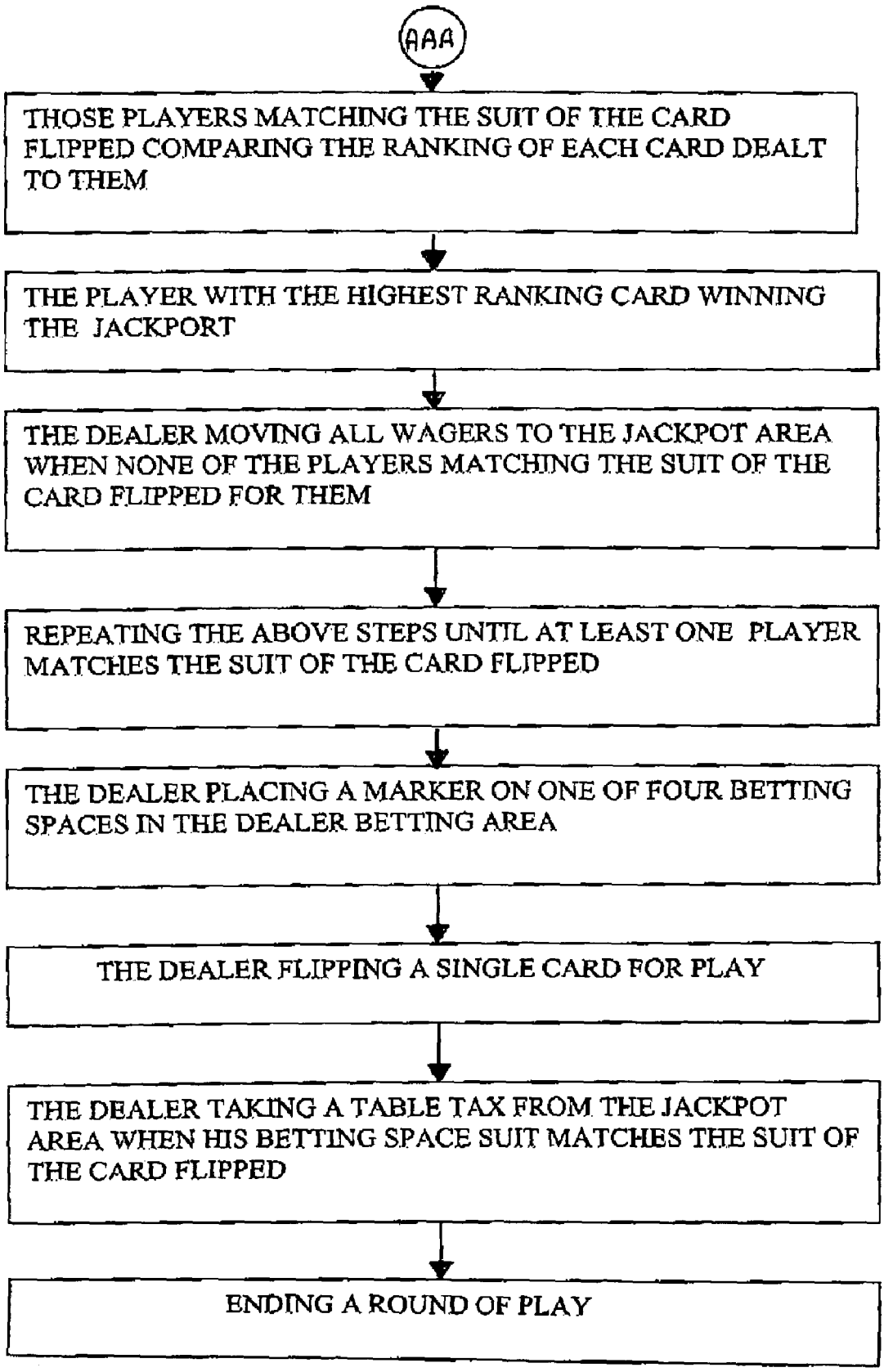
FIG. 4B is the second half of a block diagram representing the flow of the game.

FIG. 2 represents a typical betting marker 5 used in the game. FIG. 3 illustrates a typical betting board table layout 20 for the game, including a chip rack area 21 and a jackpot area 22. There are a number of betting boards 10 imprinted on the board table 20. The dealer also has the equivalent of a betting board 10' imprinted on the board table 20 near to the chip rack 21.

A player places a wager (bet) on one of the betting spaces 18 indicating a suit on the individual player's betting board 10 by placing his marker 5 on the desired betting space 18. The player then lays his bet amount in the ante space 15 above the betting spaces 18. The dealer then flips a single card for play. If the player has properly selected (matched) the suit on the dealt card, the player is now a "Survivor". The dealer then leaves the player's wager in his ante area 15 and moves to the next player in the game.

If a player unsuccessfully selects the dealt suit, it means that in this round the player is not a Survivor. The dealer then collects the wager from the unsuccessful player's ante area and places it into the table jackpot area 22, to be won by the Survivor with the highest ranking card, making him the "High Survivor". The table jackpot is built up by the antes of the players who have failed to match their marked suit with the dealt card.

If, in a given round, none of the players match their selected suits to the card dealt to them, there is no Survivor in that round, and game play continues. The table jackpot is carried over and everyone in the game from the previous round can now ante up again in the next round to try to be a Survivor. If two or more players at the table survive the round by correctly matching the card suit dealt to them, then the player with the highest ranking card is the "High Survivor" and collects the table jackpot.

When the dealer matches his suit dealt to him, he is also a Survivor and collects a small rake or "table tax" from the table jackpot. If the dealer is the High Survivor, he takes the same table tax as above and the table jackpot continues to grow in the next round. If the dealer is the only Survivor, the table tax may be increased. If there is anything left in the table jackpot, it would then be carried over to the next round. The rake or table tax can be preset by the house or casino.

The jackpot can only be won by a single High Survivor. If two surviving players have cards that tie in rank, then there is no single High Survivor and the table jackpot continues to grow. If there is only one person at the table playing the game against the dealer or "house", then the dealer becomes a player and gameplay is the same except that all ties go to the dealer giving the house the edge.

It is understood that the above-described embodiment is merely illustrative of the application. The house or casino may have the option for a single deck deal or multiple deck deal. Other embodiments may be readily devised by those skilled in the art which will embody the principles of the invention and fall within the spirit and scope thereof.

We claim:

1. A method of playing a wagering card game between a dealer and a plurality of players using a plurality of fifty-two card decks having four suits, comprising the sequential steps of:

providing a betting board table surface, including a chip rack area, a jackpot area, a dealer player betting area, and a plurality of player betting areas, each betting area having a betting board imprinted thereon, each said betting board having a top, a bottom, two opposite sides and a playing surface, said playing surface having a plurality of betting spaces arranged near to said betting board bottom, each said betting spaces representing one of said four suits, said betting board having an ante area and player's card area;

assigning each player to a betting area;

each player placing a marker on one of a plurality of four betting spaces in the player's assigned betting area;

the dealer flipping a single card for play for an individual player showing one of four said suits;

the dealer collecting the wagers of all players failing to match the suit of the card flipped for play and placing the wagers in the jackpot area;

the dealer leaving the wagers of all players matching the suit of the card flipped in the player's ante area;

those players matching the suit of the card flipped comparing the ranking of each card dealt to them;

the player with the highest ranking card winning said jackpot.

2. A method of playing a wagering game as recited in claim 1, further comprising:

the dealer moving all wagers to the jackpot area when none of the players matching the suit of the card flipped for them;

repeating the above steps until there is at least one player matches the suit of the card flipped.

3. A method of playing a wagering game as recited in claim 2, further comprising:

the dealer placing a marker on one of a plurality of four betting spaces in the dealer betting area;

the dealer flipping a single card for play;

the dealer taking a table tax from the jackpot area when his betting space suit matches the suit of the card flipped.

* * * * *